US005329829A

United States Patent [19]

Sell

[11] Patent Number: 5,329,829

[45] Date of Patent: Jul. 19, 1994

[54] INDICATING POSITIVE POSITIONING SELECTOR KNOB LOCK

[75] Inventor: Leslie J. Sell, Bothell, Wash.

[73] Assignee: Ingersoll-Rand Company, Woodcliff Lake, N.J.

[21] Appl. No.: 7,222

[22] Filed: Jan. 22, 1993

[51] Int. Cl.[5] ..... G05G 1/10

[52] U.S. Cl. ..... 74/553; 74/526; 16/121; 16/122

[58] Field of Search ..... 74/553, 526 X, 527, 74/531, 554; 16/121 X, 122 X, 123

[56] References Cited

U.S. PATENT DOCUMENTS

| | | | |
|---|---|---|---|
| 3,570,325 | 3/1971 | Kroll et al. | 74/553 |
| 3,916,721 | 11/1975 | Egger | 74/553 |
| 4,197,765 | 4/1980 | Shimoda | 74/553 |
| 4,201,096 | 5/1980 | Morrison et al. | 74/531 |
| 4,355,544 | 10/1982 | Post | 74/526 |
| 4,565,350 | 1/1986 | Rozek | 16/121 X |
| 4,575,141 | 3/1986 | Burns | 74/553 X |
| 4,779,305 | 10/1988 | Gorsek | 74/553 X |
| 4,895,043 | 1/1990 | Lee | 74/527 |
| 4,936,162 | 6/1990 | Tronetti | 74/553 |
| 5,048,365 | 9/1991 | Webb | D16/121 |

FOREIGN PATENT DOCUMENTS

| | | | |
|---|---|---|---|
| 3637451 | 5/1988 | Fed. Rep. of Germany | 74/553 |

*Primary Examiner*—Vinh T. Luong
*Attorney, Agent, or Firm*—Walter C. Vliet

[57] ABSTRACT

An interfering surface is disposed between a rotating selector knob and a stop to prevent unwanted rotation of the selector knob and wherein release of the stop requires displacement of the knob in an axial direction relative to the stop to bypass the interfering surfaces thereby permitting selective rotation of the knob.

6 Claims, 1 Drawing Sheet

INDICATING POSITIVE POSITIONING SELECTOR KNOB LOCK

BACKGROUND OF THE INVENTION

This invention relates generally to devices for retaining a selected knob selected function as may be used in lever operated hoisting devices or the like and more particularly to a device for indicating preventing the unwanted selection of a free-chain release of the hoisting chain.

Lever operated hoists are known in the prior art. Such prior art devices are known to include a selection feature wherein the hoist brake system may be temporarily released to permit the free-chain release of the hoisting chain to allow rapid deployment of the chain without the need for hand cranking out the chain. Selection of this function may be accomplished by rotating a hand operated selector knob to select the desired function. It should be appreciated, however, that the unwanted selection of the brake release function is to be avoided.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a selector lock for a lever hoist function selector knob comprising a selector knob comprised of a first shaft mounted stop and a second hand operated knob co-axially mounted about the stop for rotation and axial displacement thereabout; the stop and the hand operated knob having interfering surfaces in one position retaining mode and corresponding non-interfering surfaces in a second position selecting mode; means for effecting axial displacement of the hand operated knob relative to the stop and for selecting interference of the surfaces and thereby rotation between the stop and the hand operated knob in one axial relative position between the stop and the hand operated knob and preventing relative rotation between the stop and the hand operated knob in a second axial relative position between the stop and the hand operated knob.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Hand lever operated chain hoists and the like are known to include a manually operable knob to provide both a rapid means of taking up excess chain and as a selector for the free-chain function. The free-chain function allows rapid deployment of the lifting chain without the need to hand crank the chain out. Particularly in the case where the knob is manually operated, it is important that the selected function be retained during manual or accidental manipulation of the knob and that the retention device be sufficient to withstand relatively high rotation loads.

Figure 1:
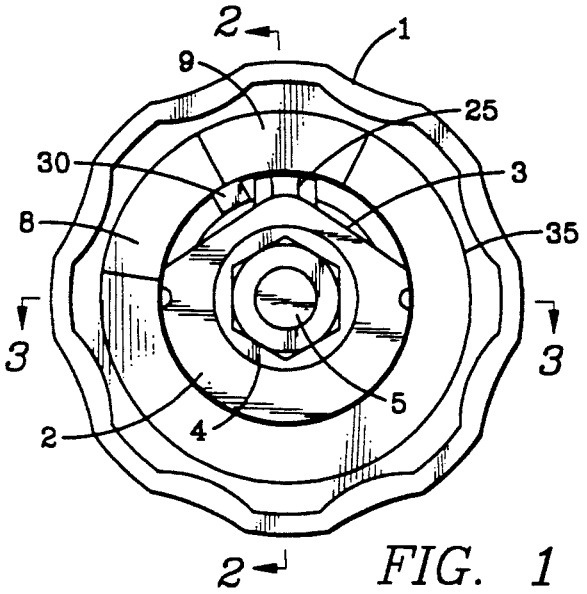
FIG. 1 is a front elevation view of a function selector knob according to the present invention.

According to the present invention, as shown in FIG. 1, a manually operable selector knob 1 is provided having a lockable function selecting feature. The exterior features of the knob are generally shown in FIG. 1 and include the manually operated selector knob 1 which is mounted for rotation about a shaft 5. The knob 1 is secured to the shaft by means of a retainer 2 and a retainer nut 4, as will be described later.

The upper portion of the retainer 2 is formed as a pointer arrow 3 to provide a relative indicator of the position of the knob 1 relative to the shaft 5. As the knob 1 is rotated relative to the shaft 5, the pointer will point to indicated selected functions as, for example, a lift sector 8, or a free spool sector 9, as shown.

Figure 2:
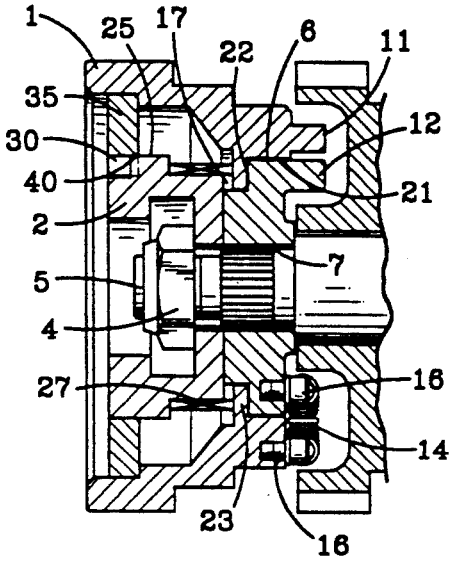
FIG. 2 is a cross sectional view of a function selector knob according to the present invention taken at section 2—2 of FIG. 1 showing the selector knob in the locked position.

FIG. 2 shows a cross sectional elevation view of the knob 1 showing the projection rearward of two function producing dogs identified as a biasing dog 11 and a stop dog 12.

It is sufficient for purposes of understanding the use of the present invention that the relative positioning of the dogs 11, 12, in rotation about the shaft 5, effect the desired function of a lever operated hoist.

Figure 4:
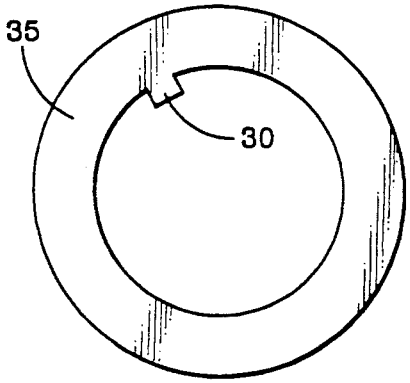
FIG. 4 is a front elevation view of a function selector indicator ring according to the present invention.

As shown in FIG. 4, a stop 6, which is essentially in the form of a stepped thick washer, is secured against rotation relative to the shaft by means of a spline 7, and held securely on the shaft by means of a retaining nut 5 and a retainer 2.

The knob 1 is free to rotate about a bearing surface 21 provided between the stop 6 and the knob 1. A ring ledge 23 provided on the selector knob is captured between the retainer 2 and a step 22 formed in the stop 6. The ring ledge 23 is narrower than the gap 17 provided between the step 22 and the retainer, thereby permitting limited axial displacement of the selector knob relative to the stop 6.

A biasing spring 14 is shown disposed between the knob 1 and the stop 6 and is held in place by two capscrews 16. The biasing spring resiliently urges relative rotation of the knob relative to the stop.

Figure 3:
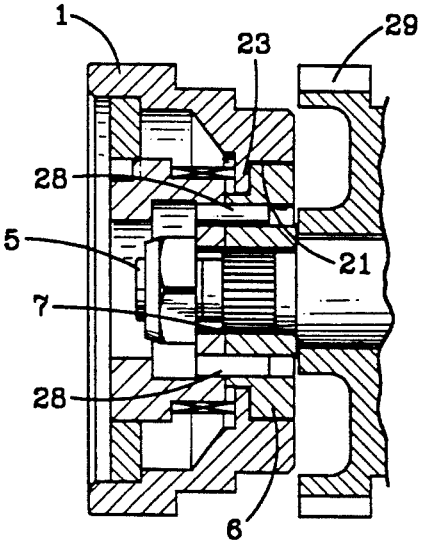
FIG. 3 is a cross sectional view of a function selector knob according to the present invention taken at section 3—3 of FIG. 1.

For purposes of the present application it should be understood that the selector lock prevents relative rotation of the selector knob relative to the stop. In the present invention the function of the selector stop is obtained by providing a projecting boss 30 on an indicator ring 35 which in turn is secured to the knob 1 (as best seen in FIGS. 2 and 3). In addition, the retainer 2 is provided with a lock nose 25 projecting from the retainer 2 at the tip of the pointer arrow 3, as best seen in FIG. 1. In the position shown in FIG. 2, the lock nose 25 will interfere with the boss 30 in the area indicated by the reference numeral 40 to prevent the relative rotation of the selector knob relative to the retainer 2 and stop 6. This position is normally maintained by the force produced on a compression spring 27 disposed between the selector knob 1 and the retainer 2.

It should be appreciated by one skilled in the art that to the extent permitted by the gap 17 the selector knob may be pulled outwards to the left, as shown in FIG. 2, thereby eliminating the interference between the lock nose 25 and the boss 30. In the extended position, the knob 1 may therefore be rotated relative to retainer 2 and the stop 6, thereby deploying the biasing dog 11 to a different relative position relative to the stop dog 12. This selects the desired function, i.e., lift or free spool, depending on the relative rotation selected.

It should be further understood that in either of the selected positions the knob is free of any frictional forces that would impede the overcentering action of the biasing spring 14.

Figure 5:
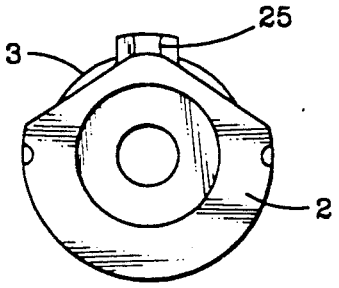
FIG. 5 is a front elevation view of a function indicator stop according to the present invention.

The indicator ring 35 and the boss 30 are best seen in FIG. 4. The retainer and the reinforced lock nose 25 are best seen in FIG. 5. Rotation of the retainer 2 relative to the stop 6 is prevented by means of two pins 28 disposed between them, as best seen in FIG. 3.

As shown, this would prevent the selector knob from being rotated in the counterclockwise direction as shown in FIG. 1 from the free spool sector selection 9 to lift sector 8 selection.

Since the knob also accomplishes the function selection through the function selection dog 11 interaction with the change gear 29, the free spool function cannot be obtained without releasing the selector lock.

Release of the selector lock is accomplished by axially extending the knob to the left as viewed in FIGS. 2 and 3. In the extended position, the inner edge of the boss 30 on the indicator ring 35 cannot contact the lock nose 25 of the retainer 2 and thereby it may pass the boss 30. In the extended position, the selector knob may be rotated as desired to the lift sector 8 or the free spool sector 9 and to thereby select that function for the lever hoist.

What is claimed is:

1. A selector lock for a lever hoist function selector knob comprising:

a selector knob assembly comprised of a stop mounted on a shaft and a hand operated open ended cylinder knob co-axially mounted about said stop for rotation and axial displacement thereabout;

said stop and said hand operated knob having interfering surfaces in one position retaining mode and corresponding non-interfering surfaces in a second position selector mode;

means for effecting axial displacement of said hand operated knob relative to said stop and for selecting interference of said surfaces and thereby rotation between said stop and said hand operated knob in one axial relative position between said stop and said hand operated knob and preventing relative rotation between said stop and said hand operated knob in a second axial relative position between said stop and said hand operated knob; and indicating means on said knob and said stop viewable through an open end of said knob for determining the rotary position of said knob.

2. A selector lock for a lever hoist function selector knob according to claim 1, wherein said interfering surfaces are comprised of a boss provided on said hand operated knob and a corresponding nose projection on said stop.

3. A selector lock for a lever hoist function selector knob according to claim 1, wherein said stop is further comprised of a shaft mounted stop and a retainer for said stop secured to said shaft.

4. A selector lock for a lever hoist function selector knob according to claim 3, wherein said means for effecting axial displacement of said hand operated knob relative to said stop comprises a gap means formed between said stop and said retainer and a boss extending from said hand operated knob for limiting axial displacement of said hand operated knob relative to said stop and said retainer.

5. A selector lock for a lever hoist function selector knob according to claim 2, wherein said boss and said nose projection are biased into engagement by means of a spring.

6. A selector lock for a lever hoist function selector knob according to claim 3, wherein said hand operated knob is disengaged by manually axially displacing said selector knob relative to said stop and said retainer and thereby displacing said boss and said nose projection out of engagement to thereby permit relative rotation.

* * * * *